US009039314B2

(12) United States Patent
Thorpe et al.

(10) Patent No.: US 9,039,314 B2
(45) Date of Patent: May 26, 2015

(54) DISPENSER WITH REMOVABLE HEAD

(75) Inventors: Timothy Thorpe, Santa Monica, CA (US); Luis Alviar, Santa Monica, CA (US)

(73) Assignee: HCT Asia Ltd, Central (HK)

( * ) Notice: Subject to any disclaimer, the term of this patent is extended or adjusted under 35 U.S.C. 154(b) by 1391 days.

(21) Appl. No.: 12/263,228

(22) Filed: Oct. 31, 2008

(65) Prior Publication Data

US 2010/0003066 A1 Jan. 7, 2010

Related U.S. Application Data

(60) Provisional application No. 61/078,275, filed on Jul. 3, 2008.

(51) Int. Cl.

| | |
|---|---|
| ***A47L 13/22*** | (2006.01) |
| ***B65D 47/42*** | (2006.01) |
| ***A45D 27/04*** | (2006.01) |
| ***A45D 34/04*** | (2006.01) |
| ***A46B 11/00*** | (2006.01) |
| *A45D 27/28* | (2006.01) |

(52) U.S. Cl.

CPC ..... *B65D 47/42* (2013.01); *A45D 27/04* (2013.01); *A45D 27/28* (2013.01); *A45D 34/042* (2013.01); *A45D 2200/1018* (2013.01); *A46B 11/001* (2013.01); *A46B 2200/1046* (2013.01)

(58) Field of Classification Search

CPC ..... B65D 47/42; A45D 27/04; A45D 27/28; A45D 34/042; A45D 2200/1018; A46B 11/001; A46B 2200/1046; A46B 11/0013

USPC ..... 401/290, 203–207

See application file for complete search history.

(56) References Cited

U.S. PATENT DOCUMENTS

| | | | | |
|---|---|---|---|---|
| 2,697,642 | A | 12/1954 | Rudy | |
| 2,725,038 | A | 11/1955 | Morris | |
| 2,825,080 | A * | 3/1958 | Bongiovanni | 401/288 |
| 2,866,993 | A | 1/1959 | Edelstone | |
| 3,111,736 | A | 11/1963 | Budreck | |
| D204,449 | S | 4/1966 | Zavodsky | |
| 3,363,775 | A | 1/1968 | Shaw | |
| 4,248,543 | A * | 2/1981 | Carrington et al. | 401/183 |
| 4,927,281 | A | 5/1990 | Gueret | |
| 4,940,350 | A * | 7/1990 | Kim | 401/209 |
| 5,050,276 | A | 9/1991 | Pemberton | |
| 5,063,947 | A | 11/1991 | Gueret | |
| 5,107,984 | A | 4/1992 | Welschoff | |
| 5,165,760 | A | 11/1992 | Gueret | |

(Continued)

FOREIGN PATENT DOCUMENTS

| | | | |
|---|---|---|---|
| CN | 201067174 | Y | 6/2008 |
| JP | 57018414 | A | 1/1982 |

(Continued)

OTHER PUBLICATIONS

The French Search Report and Written Opinion for French patent application No. 0953768, Oct. 10, 2014, 5 pages.

*Primary Examiner* — Christopher Kim

(74) *Attorney, Agent, or Firm* — Lee & Hayes, PLLC

(57) ABSTRACT

A dispenser includes a removable head or applicator and a body having a reservoir for containing a product, such as a cosmetics product or a medicinal product. By virtue of having a removable head or applicator, the dispenser is capable of dispensing various products.

11 Claims, 12 Drawing Sheets

(56) References Cited

U.S. PATENT DOCUMENTS

| | | | | |
|---|---|---|---|---|
| 5,339,483 | A | 8/1994 | Byun | |
| 5,482,059 | A | 1/1996 | Miraglia | |
| 5,992,423 | A | 11/1999 | Tevolini | |
| 6,035,865 | A | 3/2000 | Krieger | |
| 6,070,597 | A | 6/2000 | Motherhead | |
| D433,189 | S | 10/2000 | Schoon et al. | |
| D433,537 | S | 11/2000 | Schoon et al. | |
| D434,187 | S | 11/2000 | Schoon et al. | |
| 6,189,697 | B1 | 2/2001 | Davis | |
| 6,283,298 | B1 | 9/2001 | Seidler | |
| 6,532,970 | B2 | 3/2003 | Phue | |
| 6,546,937 | B2 | 4/2003 | Gueret | |
| 6,588,958 | B1 | 7/2003 | Seidler | |
| 6,591,842 | B2 | 7/2003 | Gueret | |
| 6,592,054 | B2 * | 7/2003 | Prus | 239/224 |
| 6,669,389 | B2 | 12/2003 | Gueret | |
| 6,681,936 | B2 | 1/2004 | Godshaw et al. | |
| 6,831,541 | B1 | 12/2004 | Seidler | |
| 6,866,046 | B2 | 3/2005 | Gueret | |
| 6,926,151 | B1 | 8/2005 | Perry et al. | |
| 6,974,513 | B2 | 12/2005 | Kepka | |
| 7,100,806 | B2 * | 9/2006 | Schuster et al. | 222/546 |
| 7,159,950 | B2 | 1/2007 | Young-Chul | |
| 7,524,125 | B2 * | 4/2009 | Lambert | 401/207 |
| 7,794,168 | B2 * | 9/2010 | Chang | 401/281 |
| 7,866,758 | B2 | 1/2011 | Jang | |
| 7,918,620 | B2 | 4/2011 | Del Ponte | |
| 8,074,666 | B2 | 12/2011 | Piao | |
| 8,132,285 | B2 | 3/2012 | Piao | |
| 8,185,998 | B2 | 5/2012 | Xu | |
| 2001/0037815 | A1 | 11/2001 | Gueret | |
| 2002/0117423 | A1 | 8/2002 | Jackson | |
| 2004/0018037 | A1 | 1/2004 | Gueret | |
| 2004/0168700 | A1 | 9/2004 | Dorf | |
| 2005/0031401 | A1 | 2/2005 | Gueret | |
| 2005/0224392 | A1 | 10/2005 | Perry et al. | |
| 2007/0014624 | A1 | 1/2007 | Fogelson et al. | |
| 2007/0199575 | A1 | 8/2007 | Del Ponte | |
| 2008/0283083 | A1 | 11/2008 | Piao | |
| 2009/0183328 | A1 | 7/2009 | King | |
| 2010/0017990 | A1 | 1/2010 | Piao | |
| 2010/0037407 | A1 | 2/2010 | Telwar | |
| 2010/0236004 | A1 | 9/2010 | Xu | |
| 2012/0294666 | A1 | 11/2012 | Jang | |

FOREIGN PATENT DOCUMENTS

| | | | |
|---|---|---|---|
| JP | 2003033228 | A | 2/2003 |
| KR | 200432010 | | 9/2006 |
| WO | WO0210029 | A1 | 2/2002 |

* cited by examiner

DISPENSER WITH REMOVABLE HEAD

RELATED APPLICATION

This application claims priority to U.S. Provisional Patent Application Ser. No. 61/078,275, filed on Jul. 3, 2008, which is incorporated by reference herein for all that it teaches and discloses.

BACKGROUND

Devices exist for dispensing cosmetic or medicinal products. Such devices usually consist of an outer tubular shell or housing, a delivery mechanism for displacement of the cosmetic or medicinal products, and an applicator tip. For example, in the medical industry, applicators are employed for applying medicinal products, such as ointments, to portions of the body. In the cosmetics and personal care industries, applicators are used to apply lipstick, lip balm, skin creams, lotions, and other cosmetic products to portions of the body.

In addition, various personal care implements, such as, for example, toothbrushes, hair brushes, and safety razors exist. These implements may be usable with one or more personal care products, such as toothpaste, hair gel, mouse, conditioner, or the like. These implements typically consist of a handle and a head having a brush, razor, or other tool attached for cleaning, manipulating, cutting, or otherwise grooming a part of the body.

Existing cosmetic and medicinal dispensers and personal care implements have limited functionality, in that each dispenser or implement is typically designed for a specialize purpose. Thus, consumers typically need to buy many different dispensers and implements, one for each of their medical, cosmetic, and grooming needs. Accordingly, there remains a need in the art for improved dispensers and implements.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This application describes dispensers and implements comprising a removable head or applicator. The heads of various dispensers or implements may interchangeable, such that a single dispenser or implement may selectively have a variety of different heads attached. By virtue of having a removable head or applicator, such dispensers and implements are adaptable to dispense various different cosmetic, medicinal, and/or personal care products.

Generally, a dispenser according to this disclosure comprises a reservoir for containing a product to be dispensed, a removable head comprising a delivery passageway through which the product can be dispensed, and a delivery mechanism for dispensing the product from the reservoir through the delivery passageway and out of the head. An implement according to this disclosure generally comprises a handle and a removable head. In various embodiments, implements may or may not include a reservoir and delivery passageway to deliver a product to the removable head.

The removable heads may be removably coupled to the dispenser or implement by a variety of attachment means, such as by snap fit, by screw threads, by a twist lock mechanism, by magnetic force, by interference fit, combinations of any of the foregoing, or the like.

Illustrative Dispenser with Removable Head (Magnetic)

Figure 1:
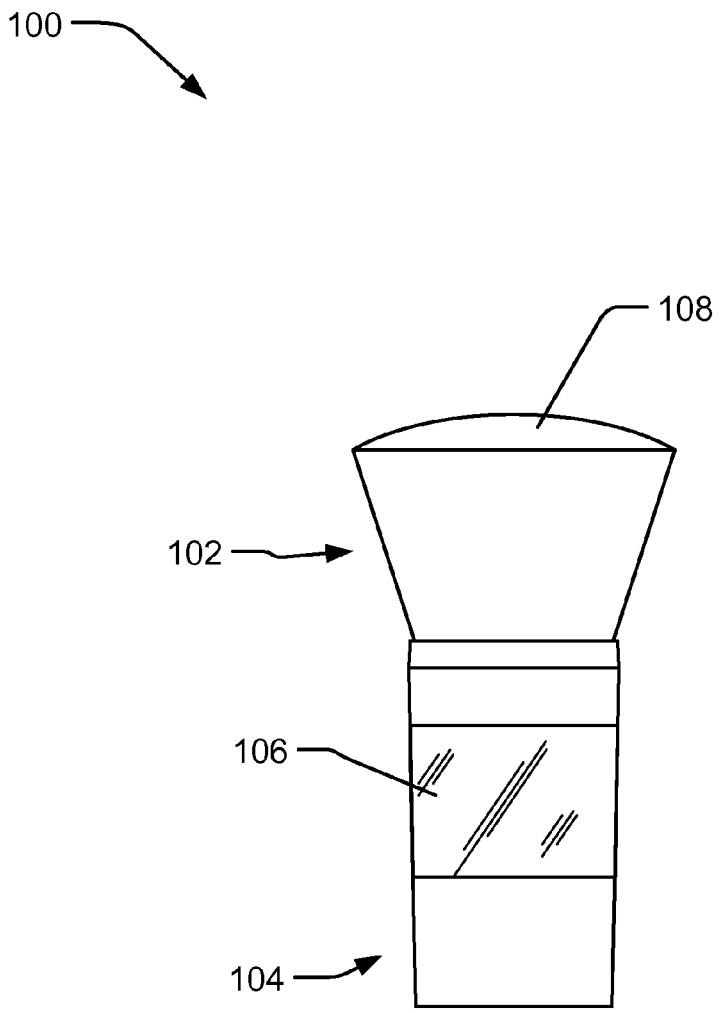
FIG. 1 depicts an illustrative dispenser with a removable head magnetically coupled to a body of the dispenser.

FIG. 1 depicts an illustrative dispenser 100 with a removable head 102. The dispenser 100 includes a body 104 with a reservoir 106 for containing a cosmetic, medicinal, personal care, or other product. In the illustrated embodiment, the reservoir 106 is shown to have clear plastic walls so that contents of the reservoir are visible.

The head 102 comprises an applicator 108 for application of the product to the body. In the embodiment shown in FIG. 1, the applicator 108 comprises a soft brush for application of a product such as foundation, blush, or other loose powder cosmetic products.

Figure 2:
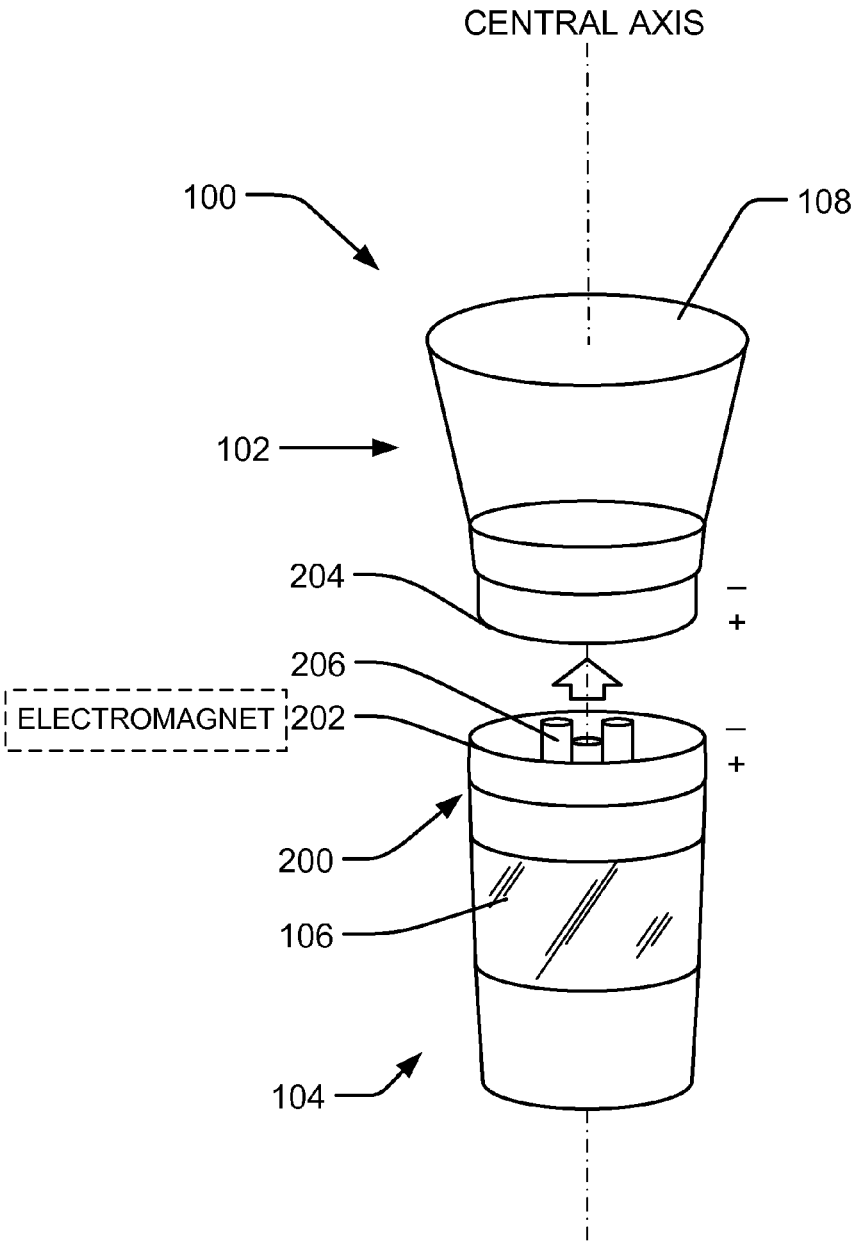
FIG. 2 is an exploded view of the dispenser of FIG. 1.

FIG. 2 is an exploded view of the dispenser 100, with the head 102 removed. As shown in FIG. 2, the body 104 includes a collar 200 that includes a magnetic retention mechanism 202 to couple the head 102 to the body 104. In this embodiment, the magnetic retention mechanism 202 comprises a magnetic ring disposed around a circumference of the collar 200 to attract and retain a ferromagnetic member 204 disposed in, on, or about the head 102. In the illustrated example, the ferromagnetic member 204 comprises a metal sleeve encircling a base of the applicator 108.

While the magnetic retention mechanism 202 is shown in this embodiment as a magnetic ring, in other embodiments, the magnetic retention mechanism on the body 104 may comprise a magnetic plate or disk, one or more magnetic posts, one or more smaller magnets disposed about the collar 200 (e.g., arranged in a circle around the collar 200, arranged in the center of the collar 200, arranged on opposite sides of the collar 200, arranged in a triangle or square shape around the collar 200, or in any other suitable orientation). Likewise, while the ferromagnetic member 204 is depicted as a sleeve, in other embodiments, the ferromagnetic member may be configured in any other suitable shape, size and configuration. The ferromagnetic member 204 may take the same or similar shape as the magnetic retention mechanism 202, may be complimentary in shape and configuration to the magnetic retention mechanism 202, or may be configured differently than the magnetic retention mechanism 202.

Additionally, while the magnetic retention mechanism 202 is depicted as being disposed on the body 104 and the ferromagnetic member 204 is depicted as being disposed on the head 102, in other embodiments, the locations of the magnetic retention mechanism 202 and ferromagnetic member 204 could be switched. Additionally, instead of using a ferromagnetic material, both the body 104 and the head 102 could each include one or more magnets arranged with the poles substantially opposed, so as to attract one another.

The collar also includes one or more pipes or tubes 206, which form delivery passageways to convey product from the reservoir 106 to the head 102. The head 102 also includes a plurality of apertures (not shown) that correspond to and align with the tubes 206 to allow the product to pass into the applicator 108 of the head 102. While three tubes 206 are shown, any number of one or more tubes of any size, shape, and configuration may be used. In other embodiments, instead of tubes, the collar may simply include apertures that align with apertures in the head 102.

In one specific example, one or more magnets may be disposed in the collar 106 on a base of tubes 206. The head 102 may include a steel ring disposed in a cavity around a base of the applicator 108. The magnets in the collar 106 being configured to attract and retain the steel ring in the head 102.

Figure 3A:
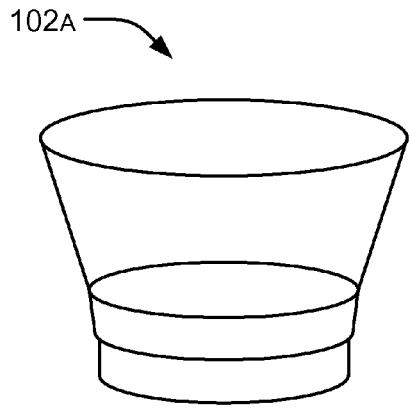
FIGS. 3A-3C are front views of removable heads that are couplable to the dispenser of FIG. 1.
Figure 3B:
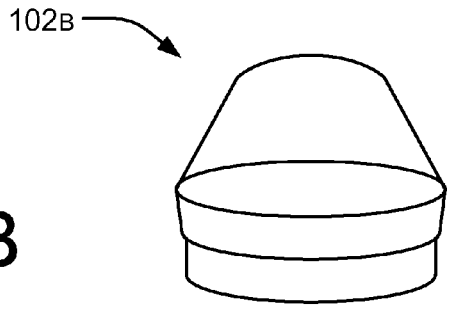
Figure 3C:
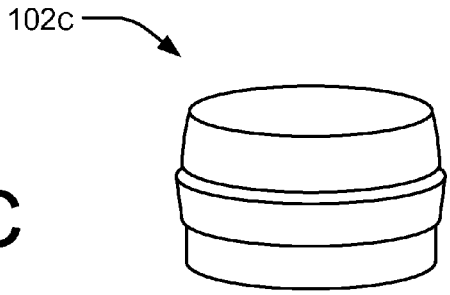

FIGS. 3A-3C depict three illustrative heads that may be used with the dispenser 100 of FIG. 1, each having a different cosmetic applicator. FIGS. 3A and 3B illustrate heads 102*a* and 102*b* having two alternative applicator brush designs. FIG. 3C illustrates a head 102*c* having a sponge applicator. Still other cosmetic applicators may also be used, such as a puff, a pad, or the like.

In one example, the heads 102 may be removed from the body 104 simply by applying sufficient force to overcome the magnetic force attracting the head to the body. In another example, a release may be provided to disengage the head from the body by rotating one or more of the magnets (in examples where magnets are used on both the head and the body) such that the same magnetic poles are no longer opposite one another and therefore no longer attract one another. That is, upon actuating a release, the magnetic poles may be rotated such that the magnets actually repel one another. In still another example, an electromagnet may be used as the magnetic retention mechanism 202, and the electromagnet may be turned off upon actuation of a release.

In addition to coupling the head to the body, the magnetic retention mechanism may provide one or more additional benefits, such as pain reduction, stress reduction, etc. due to the magnetic fields generated.

Illustrative Dispenser with Removable Head (Snap)

Figure 4:
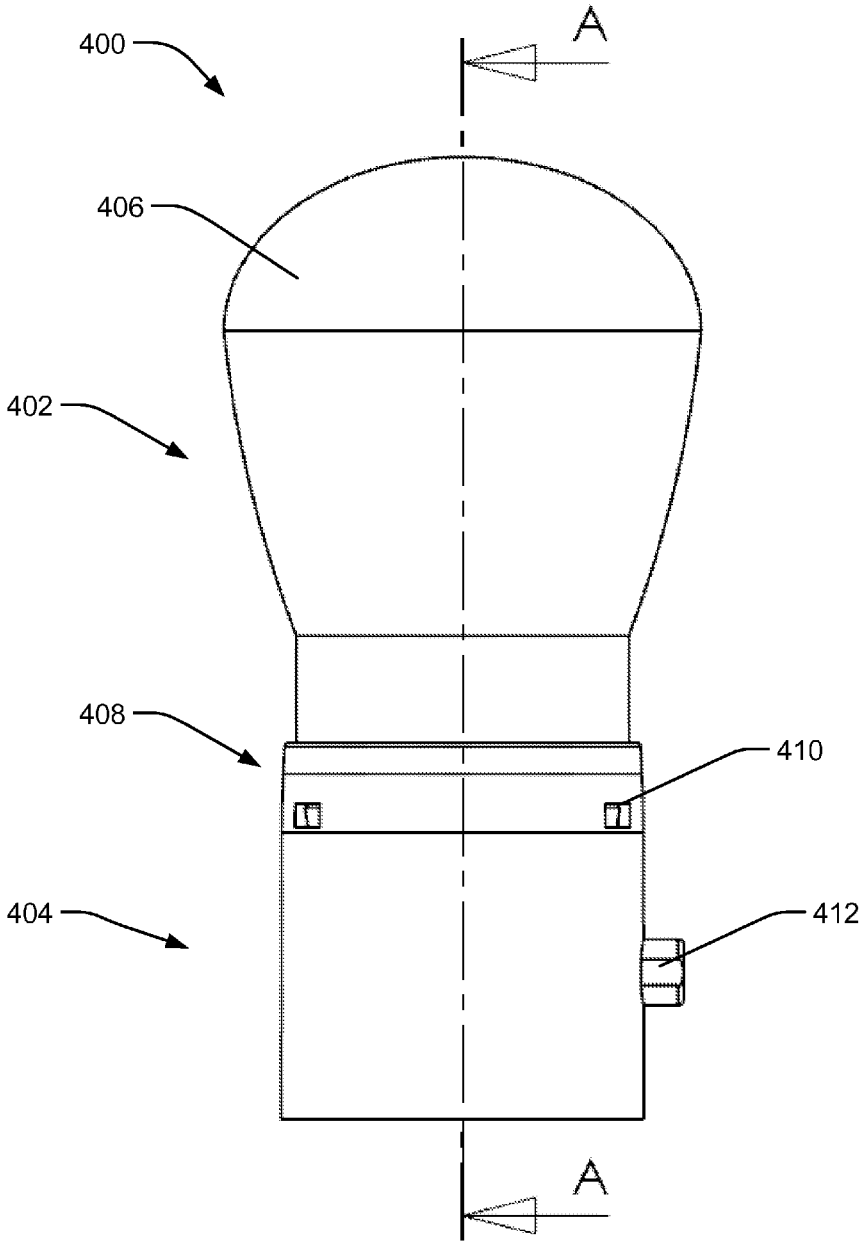
FIG. 4 is a partial front view of another illustrative dispenser with a removable head coupled to the dispenser with a snap connection.
Figure 5:
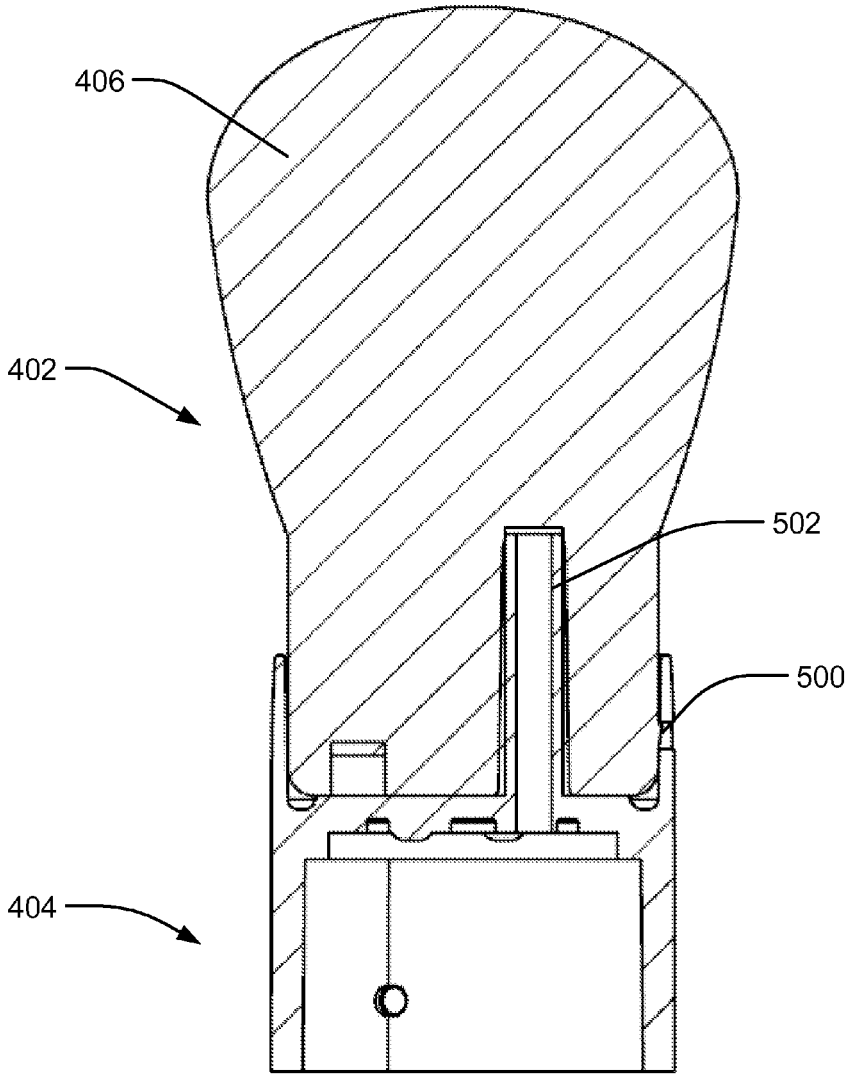
FIG. 5 is a cross-sectional view of the dispenser shown in FIG. 4, taken along line A-A of FIG. 4.
Figure 6:
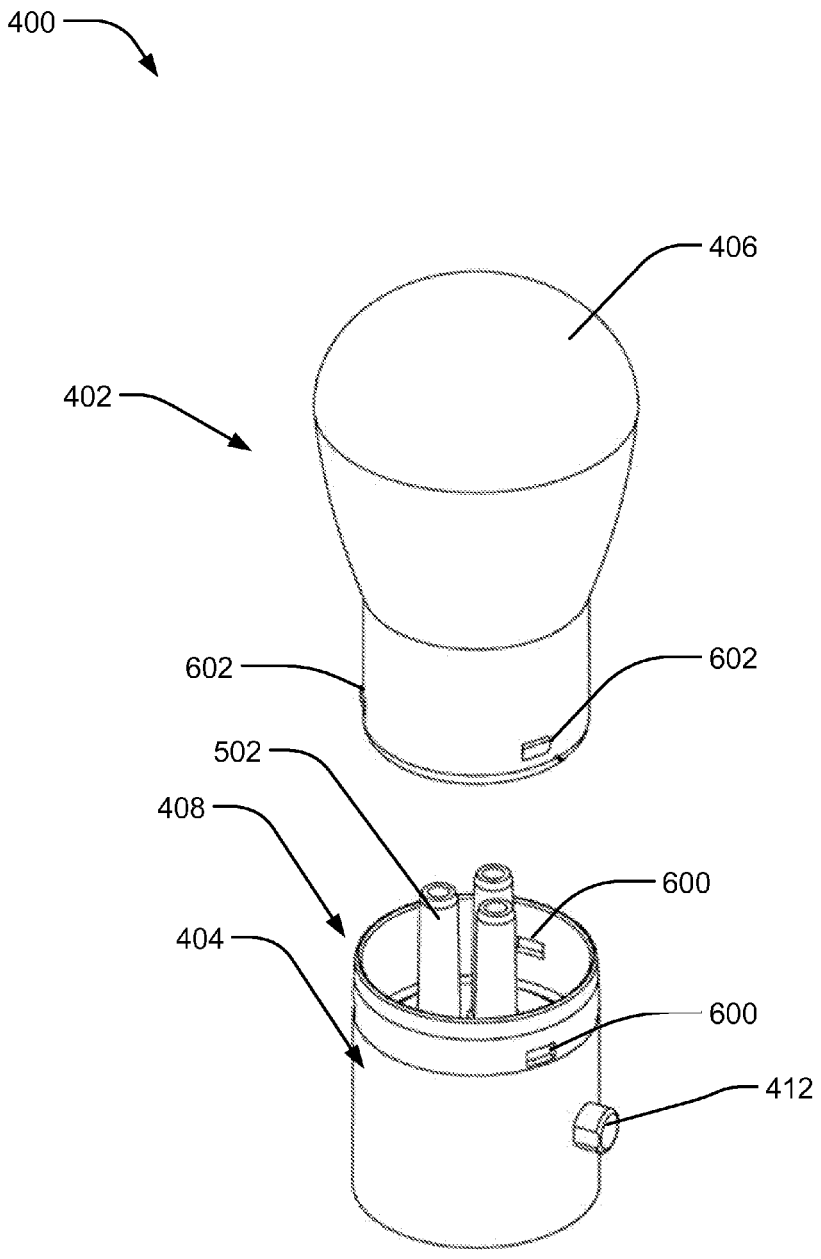
FIG. 6 is an exploded view of the dispenser of FIG. 1.

FIGS. 4-6 illustrate an illustrative dispenser 400 with a head 402 removably coupled to a body 404 by a snap connection. The head 402 in this figure comprises yet another variety of applicator brush 406. In this embodiment, the body 404 again includes a reservoir (not shown) and a collar 408. In FIG. 4, only the collar 408 and an upper portion of the body is shown; the reservoir and remainder of the body have been omitted for clarity.

The collar 408 is coupled to or formed integrally with the body 404 and includes a snap retention mechanism 410 to selectively couple the head 402 to body 404. The snap retention mechanism 410 may be selectively disengaged, to allow the head 402 to be removed, by depression or other actuation of a release 412 in a sidewall of the body 404.

FIG. 5 is a cross-section of the dispenser 400, taken along line A-A in FIG. 4. As shown in FIG. 5, the snap retention mechanism 410 includes one or more snap features on the collar 408 configured to engage one or more snap features complimentary snap features on the head 402. FIG. 5 also shows tubes 502 extending from the collar 408 into apertures in the head 402 to provide delivery passageways to convey product from the reservoir (not shown) to the applicator.

FIG. 6 is an exploded view of the dispenser 400 of FIG. 4, showing additional details of the snap features 500 of the snap retention mechanism 410. In this embodiment, the snap features 500 include one or more apertures or notches 600 in the collar 408 configured to receive and selectively retain one or more correspondingly sized protrusions 602 on the head 402. Alternatively, the notches 600 could be disposed in the head 402 and the protrusions 602 could be disposed in the collar 408. Still further the number, size, shape, and configuration of the snap features 500 may vary. One alternatively example, the snap features 500 may comprise a ridge encircling the head that is sized to engage a trough formed in the collar or vice versa.

When the head 402 is installed on the body 404, the protrusions 602 fit in the notches 600 and couple the head 402 to the body 404. To remove the head 402, a user may simply pull the head away from the collar 408 (and the force may cause the tabs 602 to pull out of the notches 600), or the user may actuate a release mechanism, such as release 412. Actuation of release 412 may cause the collar 408 to deform slightly, thereby causing the tabs 602 to disengage from the notches 600. Alternatively, the release 412 may cause a pin, cam, piston, or other member to force the head 402 away from the body 404, thereby disengaging it from the collar 408.

Illustrative Dispenser with Removable Head (Threaded)

Figure 7:
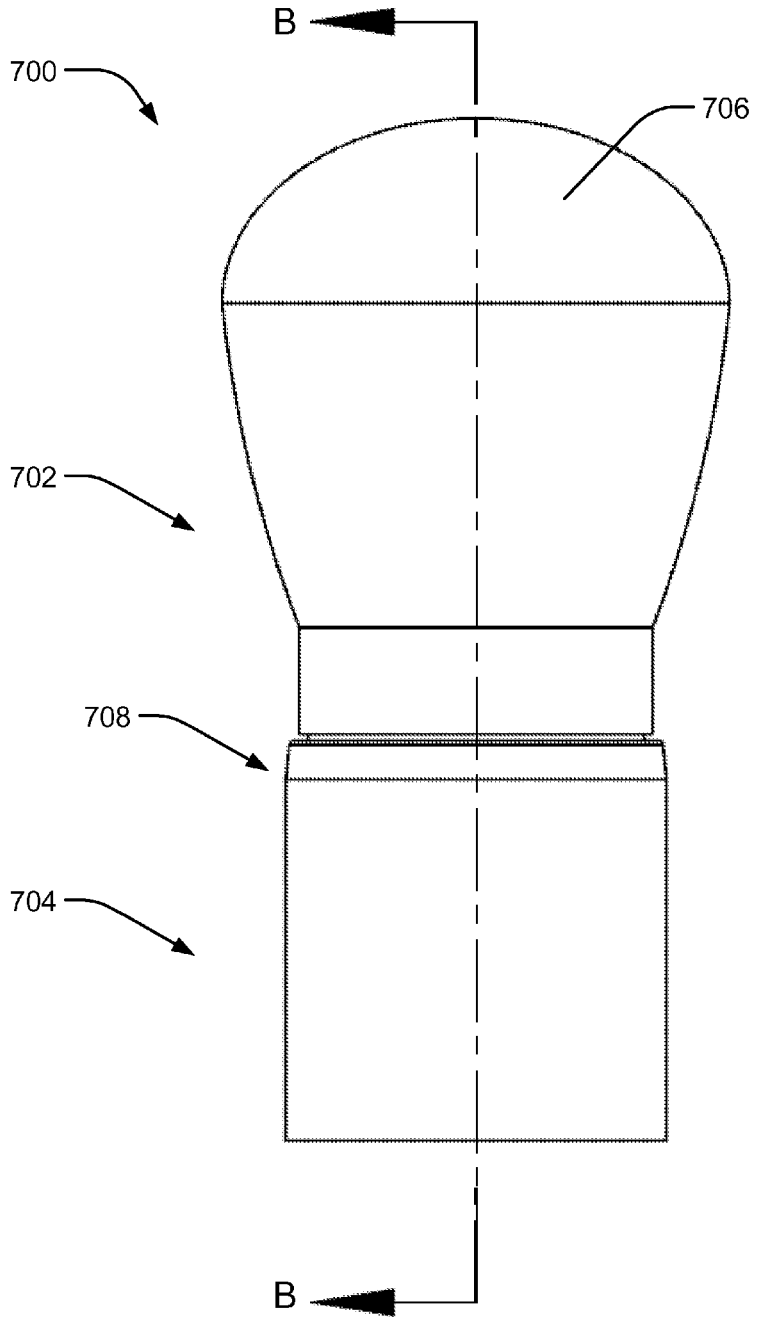
FIG. 7 is a partial front view of another illustrative dispenser with a removable head coupled to the dispenser with a threaded connection.

FIGS. 7-10 depict an illustrative dispenser 700 with a head 702 removably coupled to a body 704 by a threaded connection. The head 702 again comprises an applicator brush 706. In this embodiment, the body 704 again includes a reservoir (not shown) and a collar 708. In FIG. 7, only the collar 708 and an upper portion of the body is shown; the reservoir and remainder of the body have been omitted for clarity. This embodiment is similar to that of FIG. 4, except that instead of a snap retention mechanism, in this embodiment the head 702 is removably coupled to the body 704 by threaded engagement.

Figure 8:
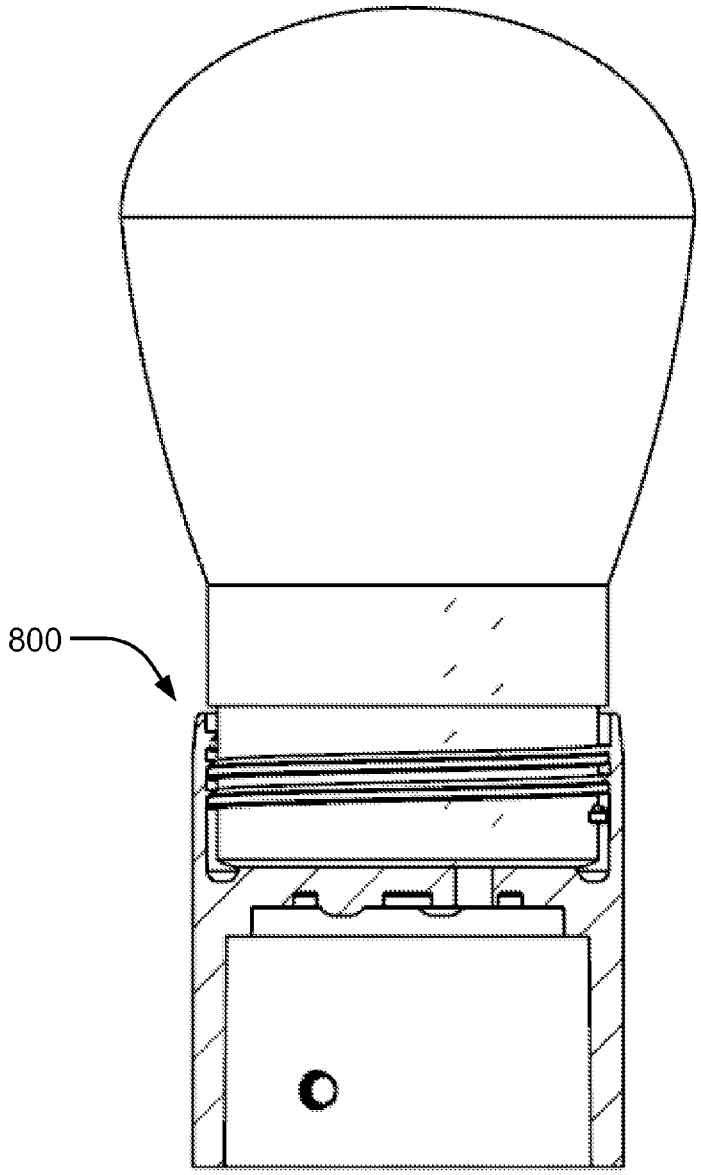
FIG. 8 is a cross-sectional view of the dispenser shown in FIG. 7, taken along line B-B of FIG. 7.

FIG. 8 is a cross-section of the dispenser 700 taken along line B-B in FIG. 7, and illustrates a threaded retention mechanism 800 of the dispenser 700.

Figure 9:
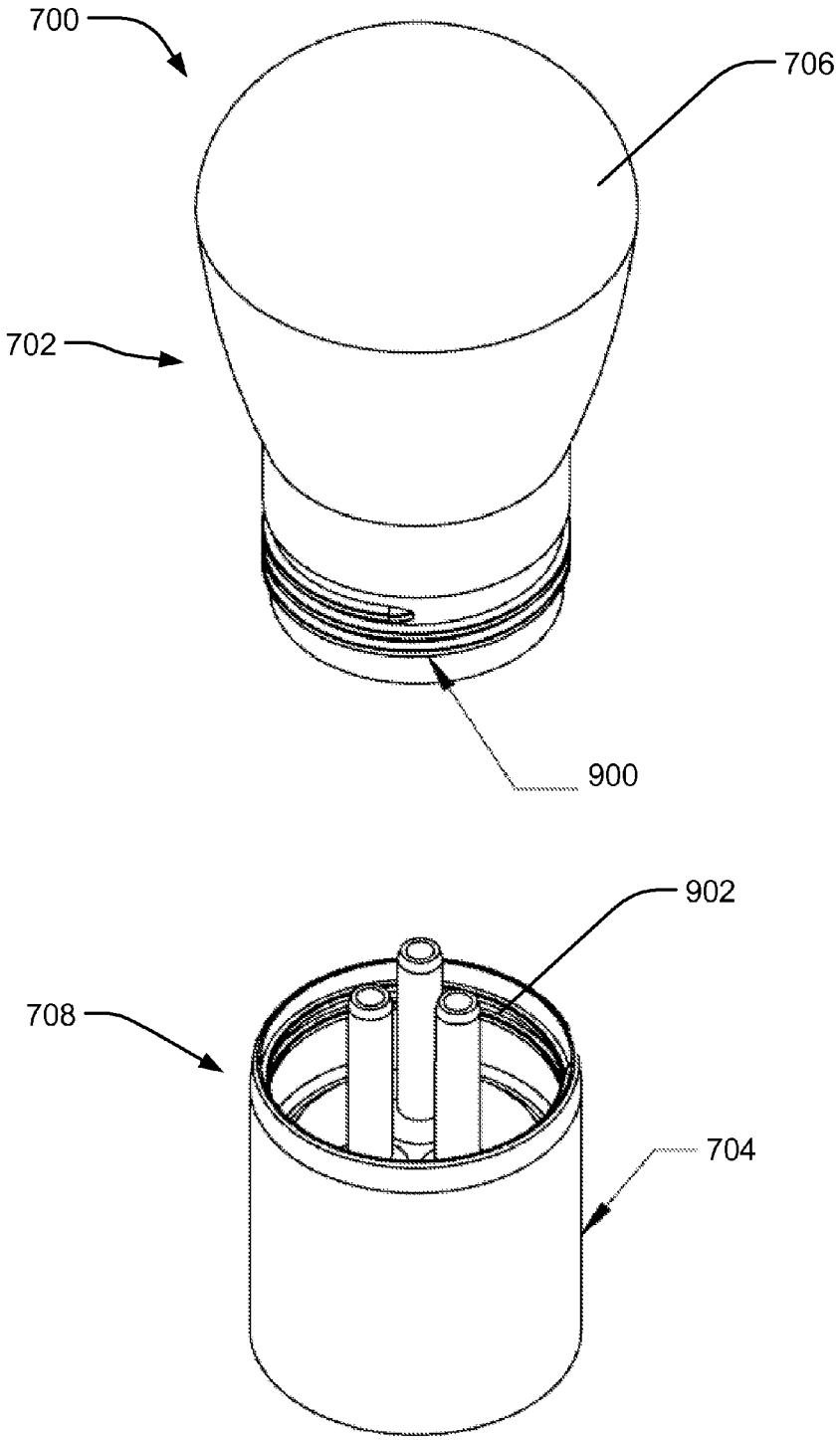
FIG. 9 is an exploded view of the dispenser of FIG. 7.
Figure 10:
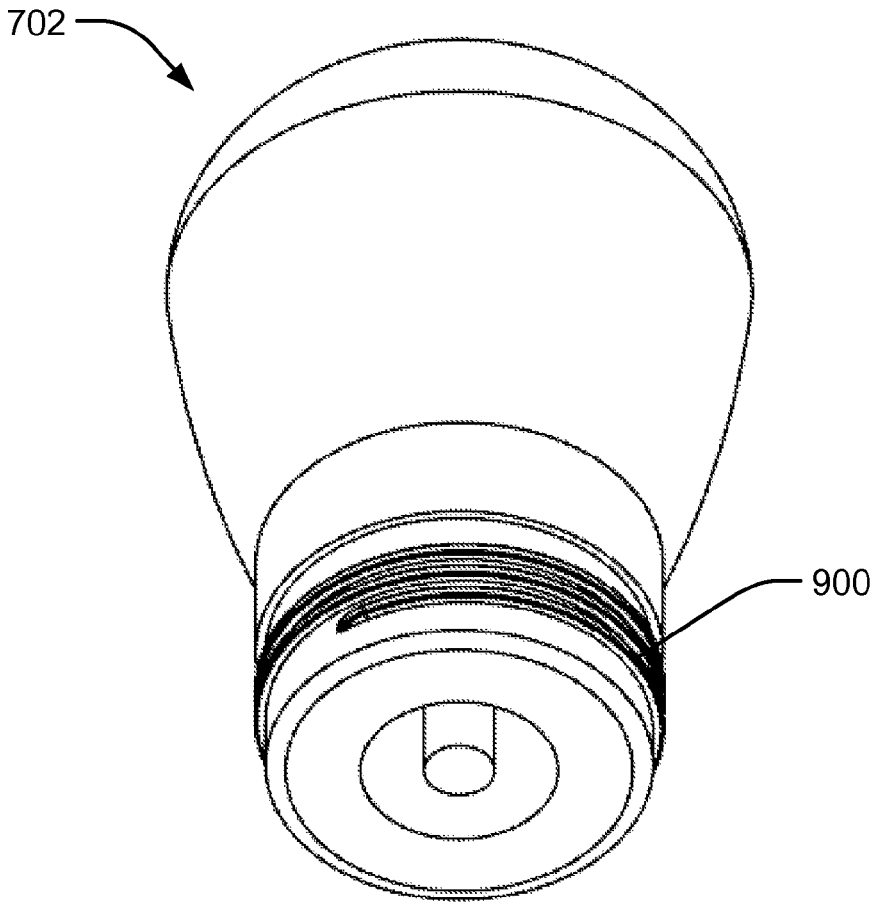
FIG. 10 is a bottom perspective view of the head of the dispenser of FIG. 7.

FIGS. 9 and 10 illustrate the threaded retention mechanism 800 in more detail. As shown in FIGS. 9 and 10, the head 702 includes threads 900 that engage threads 902 inside the collar 708.

Illustrative Removable Heads

FIGS. 11A-11C and 12A-12C depict alternative heads that may be coupled to dispensers or implements according to this disclosure. Any of these heads may be coupled to a dispenser body using any of the techniques described herein (e.g., magnets, snap, threaded, press fit, etc.).

Figure 11A:
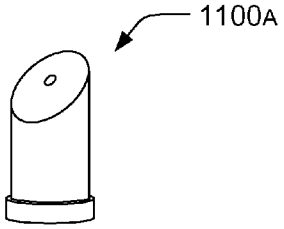
FIGS. 11A-11C are depict illustrative heads that are variously usable to dispense cosmetic products.
Figure 11B:
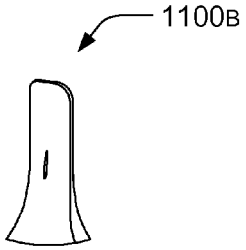
Figure 11C:
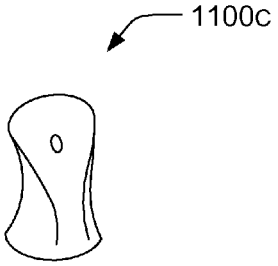

FIGS. 11A-11C depict heads 1100A, 1100B, and 1100C, which are variously usable to dispense cosmetic products, such as, for example, lipstick, chap stick, lip gloss, lotions, creams, gels, etc.

Figure 12A:
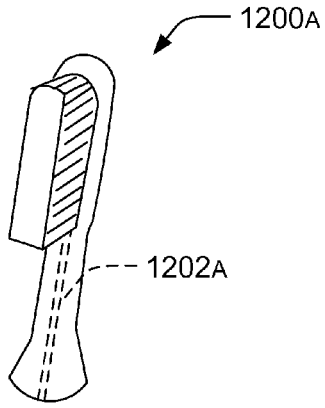
FIGS. 12A-12C depict illustrative heads that may be used in various aspects of grooming.
Figure 12B:
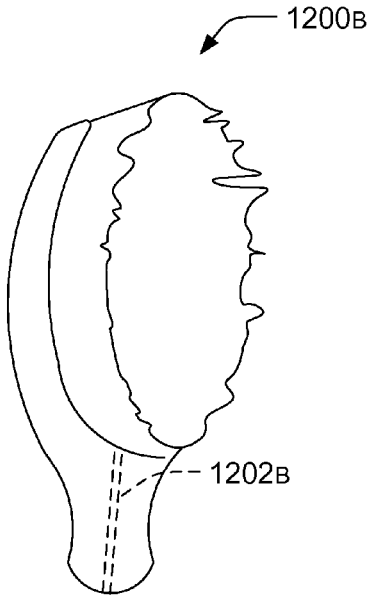
Figure 12C:
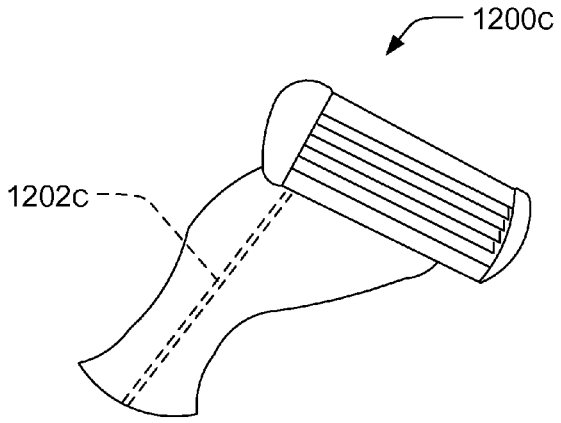

FIGS. 12A-12C depict heads 1200A, 1200B, and 1200C, which may be used in various aspects of grooming. In some examples, the heads 1200A, 1200B, and 1200C may include delivery passageways 1202A, 1202B, and 1202C to dispense personal care products, such as, for example, toothpaste, hair gel, mouse, shaving cream, aftershave, etc.

Unless otherwise indicated above, various components of the foregoing implementations may be constructed of any suitable material. By way of example and not limitation, suitable materials may include plastics, metals (e.g., aluminum, titanium, steel, nickel, tin, copper, brass, alloys thereof, etc.), ceramics, composites, combinations of the foregoing, or the like.

CONCLUSION

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

What is claimed is:

1. A cosmetic dispenser for applying a cosmetic product to a surface, the dispenser comprising:

a body having a reservoir holding the cosmetic product, the body having a first magnetic retention mechanism portion with a first magnetic pole;

a head removably coupled to the body, the head comprising:

an applicator disposed in the head; and a second magnetic retention mechanism portion with a second magnetic pole, the first and second magnetic poles being rotatable relative to each other to induce an attraction and a repulsion between the first and second magnetic poles, removably coupling the second magnetic retention mechanism to the first magnetic retention mechanism portion, and thereby removably coupling the head to the body;

multiple pipes defining a delivery passageway, wherein the multiple pipes extend through at least a portion of the applicator and are configured to deliver the cosmetic product from the reservoir to the surface.

2. A dispenser according to claim 1, wherein the first magnetic retention mechanism portion comprises a magnetic ring disposed around a circumference of a collar disposed in the body and the second magnetic retention mechanism portion comprises a complimentary member disposed in, on, or about the head.

3. A dispenser according to claim 2, wherein the collar comprises the multiple pipes forming a delivery passage way configured to convey the cosmetic product from the reservoir through at least the portion of the applicator and to the surface.

4. A dispenser according to claim 1, wherein the head comprises an applicator brush or a sponge applicator.

5. A dispenser according to claim 1, wherein the second magnetic retention mechanism portion comprises a magnetic sleeve encircling a base of the head.

6. A cosmetic dispenser comprising:

a body having a reservoir containing a cosmetic product;

a head removably coupled to the body;

a brush disposed in the head for application of the cosmetic product to a surface;

multiple pipes forming a delivery passageway configured to deliver the cosmetic product from the reservoir to the surface, wherein the multiple pipes extend through at least a portion of the brush;

an electromagnetic retention mechanism located on the body; and a ferromagnetic member located on the head, wherein the electromagnetic retention mechanism located on the body attracts the ferromagnetic member to removably couple the head to the body when the electromagnetic retention mechanism is actuated.

7. A dispenser according to claim 6, wherein the electromagnetic retention mechanism comprises a magnetic ring disposed around a circumference of a collar disposed in the body.

8. A dispenser according to claim 6, wherein the ferromagnetic member comprises a metal sleeve encircling a base of the brush.

9. A dispenser according to claim 6, wherein a shape of the ferromagnetic member is complimentary to a shape of the electromagnetic retention mechanism.

10. A cosmetic dispenser for applying a cosmetic product to a surface, the dispenser comprising:

a body having a reservoir for holding the cosmetic product, the body having a first retention mechanism portion;

a head removably coupled to the body, the head comprising:

an applicator disposed in the head;

a second retention mechanism portion removably coupled to the first retention mechanism portion, thereby removably coupling the head to the body, wherein actuation of the first or second retention mechanism slightly deforms the body, disengaging the first retention mechanism from the second retention mechanism; and multiple pipes defining a delivery passageway, wherein the multiple pipes extend through at least a portion of the applicator and are configured to deliver the cosmetic product from the reservoir to the surface.

11. A dispenser according to claim 10, further comprising a release mechanism configured to disengage the head from the body.

* * * * *